US007708610B1

(12) United States Patent
Horan et al.

(10) Patent No.: US 7,708,610 B1
(45) Date of Patent: May 4, 2010

(54) ROWING OAR SYSTEM WITH ARTICULATING HANDLE

(76) Inventors: Richard Horan, 246 Beach 127th St., Belle Harbor, NY (US) 11694; Joel Miller, 196 Gibbs St., Newton Center, MA (US) 02459

( * ) Notice: Subject to any disclaimer, the term of this patent is extended or adjusted under 35 U.S.C. 154(b) by 143 days.

(21) Appl. No.: 12/070,087

(22) Filed: Feb. 14, 2008

Related U.S. Application Data

(60) Provisional application No. 60/901,722, filed on Feb. 15, 2007.

(51) Int. Cl.
*B63H 16/04* (2006.01)
*B63H 16/10* (2006.01)
*B63H 16/00* (2006.01)

(52) U.S. Cl. ..... 440/102; 440/101; 440/104; 440/105; 440/106

(58) Field of Classification Search ..... 440/101, 440/102–110; 416/74
See application file for complete search history.

(56) References Cited

U.S. PATENT DOCUMENTS

| | | | | |
|---|---|---|---|---|
| 402,114 | A * | 4/1889 | Sweet | 440/102 |
| 2,154,018 | A * | 4/1939 | Wagele | 440/107 |
| 2,213,538 | A * | 9/1940 | Whitehead | 416/74 |
| 7,144,284 | B1 * | 12/2006 | Horan et al. | 440/102 |

* cited by examiner

*Primary Examiner*—Daniel V Venne
(74) *Attorney, Agent, or Firm*—Michael J. Tavella

(57) ABSTRACT

An improved oar that has an oarlock assembly, which holds the main oar shaft and parallel link in line with each other while allowing them to pivot fore and aft and up and down; an oar shaft; a parallel link; and a knuckle. The knuckle positions the handle via a sleeve, and the parallel link that is positioned by a pivot on the end of an arm. Additionally, there is a universal joint between the oar shaft and the handle, in line with the parallel link pivot, that allows the blade to be feathered while keeping the handle perpendicular to the rowing shell at every point in the stroke.

20 Claims, 18 Drawing Sheets

ROWING OAR SYSTEM WITH ARTICULATING HANDLE

CROSS REFERENCE TO RELATED APPLICATIONS

This application claims benefit of Provisional application 60/901,722 filed Feb. 15, 2007.

STATEMENT REGARDING FEDERALLY SPONSORED RESEARCH AND DEVELOPMENT

Not Applicable

BACKGROUND OF THE INVENTION

1. Field of the Invention

This invention relates to a device that keeps the oar handle perpendicular to the rowing shell at every point of the stroke and particularly to a device that keeps the oar handle perpendicular to the rowing shell at every point of the stroke by creating a parallelogram structure.

2. Description of the Prior Art

Presently, there are two types used in rowing. The first is called a sweep oar. Sweep oars are the larger variety and are designed so that each rower uses just one oar. Sweep shells always have even numbers of oarsman on each side of the shell. Classes include Pairs (2×), Fours (4×), and Eights (8×). Each class can include a coxswain to steer and coach.

The second oar type is called a scull. Sculls are about 20% smaller than sweeps. Each sculler uses two sculls, one in each hand. In sculls competition there are singles (1×), doubles (2×), and quads (4×).

For the purpose of this application, the present invention uses the term "oars" as a general term that include both sweeps and sculls as described above.

The Problem with Current Straight-Shaft (non-Articulating) Oars is that the severe angle of the oar handle at the beginning and end of the stroke results in many problems relative to boat speed and rowing ergonomics. Some of these problems are: rowers must twist their upper torsos at the catch (beginning of stroke); the length of the stroke is limited by the length of the rowers outside arm; power is limited by the fact that the outside arm is doing most of the work; this reduction of stroke length and power reduces speed; the twisting of the rower's upper torso can cause lower spine and muscle injury' the twisting also results in the asymmetric muscle development; the twisting of the rowers disrupts the movement of the shell through the water; and, most ergs (training machines) feature a symmetrical stroke which differs greatly from the asymmetric stroke of a sweep oar, which makes off-water training less effective and relevant.

BRIEF DESCRIPTION OF THE INVENTION

The instant invention overcomes all of the above-mentioned problems by keeping the handle perpendicular to the shell at every point in the stroke. By using this structure the length of the stroke is increased as the end of the handle is now closer to the rower; power is increased as both arms can now share the work equally; the increase in effective stroke length also increases power; sweep rowers can now keep their torsos essentially straight throughout the stroke; the reduction/elimination of twisting of the rower's upper torso reduces the likelihood of lower spine and muscle injury; the new arrangement provides for more symmetric stroke and muscle development; the reduction in twisting allows the boat to move through the water with less disruption; and, the new symmetrical stroke is more similar to most ergs (training machines), thereby making off-water training more effective and relevant.

The system uses the following primary components: an oarlock assembly, which holds the main oar shaft and parallel link in line with each other while allowing them to pivot fore and aft and up and down; an oar shaft; a parallel link; and a knuckle. The knuckle positions the handle via a sleeve, and the parallel link that is positioned by a pivot on the end of an arm. Additionally, there is a universal joint between the oar shaft and the handle, in line with the parallel link pivot, that allows the blade to be feathered while keeping the handle perpendicular to the rowing shell at every point in the stroke.

DETAILED DESCRIPTION OF THE INVENTION

The present invention describes two alternate means to effect the functionality of the articulated handle: a single parallel link configuration and a double parallel link configuration.

Single Parallel Link Configuration

Figure 3:
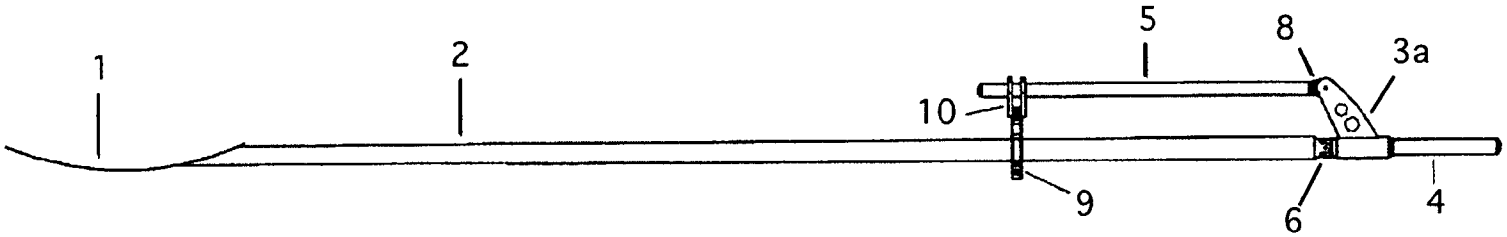
FIG. 3 is a detail view of a parallel link-single parallelogram mechanical design.

The first and preferred method is a single-parallel link configuration consisting of the main oar shaft and one parallel link. This is shown in FIG. 3. This design incorporates one parallelogram, on one side of the main oar shaft to keep the handle perpendicular to the shell at every point in the stroke.

Double Parallel Link Configuration

Figure 4:
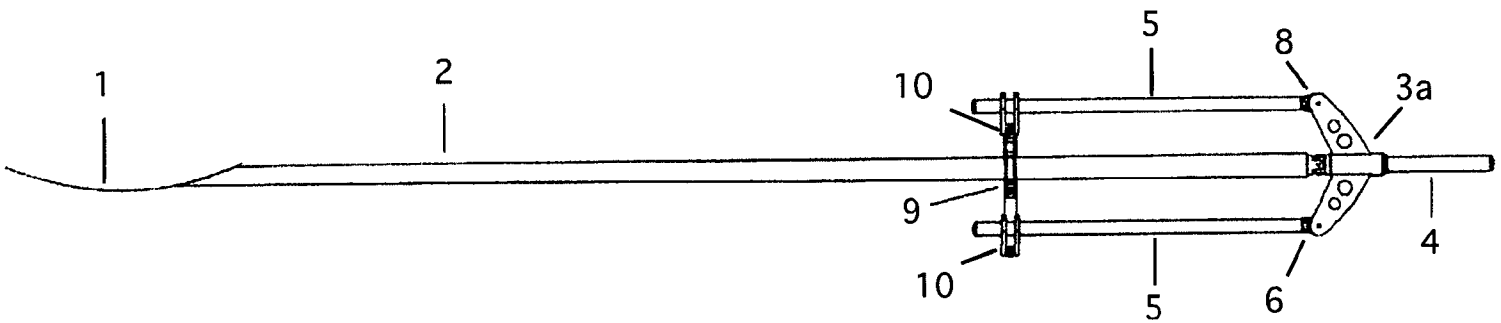
FIG. 4 is a detail view of a parallel link-double parallelogram mechanical design.

The second method is a double parallel link configuration consisting of the main oar shaft and two parallel links. This is shown in FIG. 4. This design incorporates two parallelograms, one on either side of the main oar shaft, to keep the handle perpendicular to the shell at every point in the stroke.

Functionality

From an operational standpoint, the improved oar is functionality is the same as the current straight handled oar. The blade end of the present invention does not differ from that of a traditional oar. In the present invention, the blade continues to make an arc through the water while it changes angles throughout the stroke, just as it does with traditional oars. The primary difference between current straight handled oars and the present invention is the articulated handle design allows the handle to remain perpendicular to the shell (and rower) at every point in the stroke, which as significant advantages.

Figure 1A:
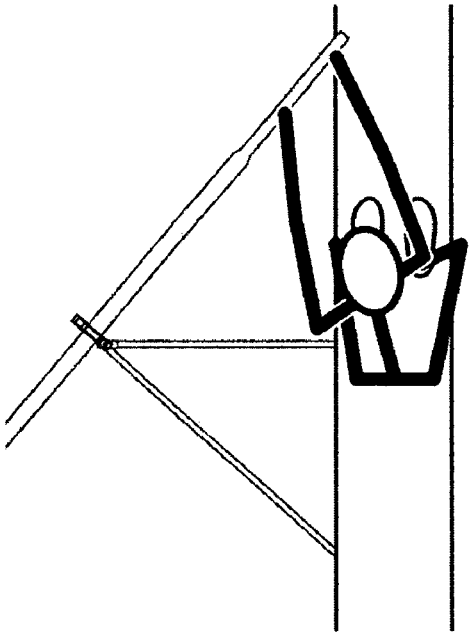
Figure 1a Prior Art
FIG. 1*a* is a diagrammatic overhead view of a sweep oarsman, using straight oar shaft and handle, at the beginning of a stroke, as prior art.
Figure 1B:
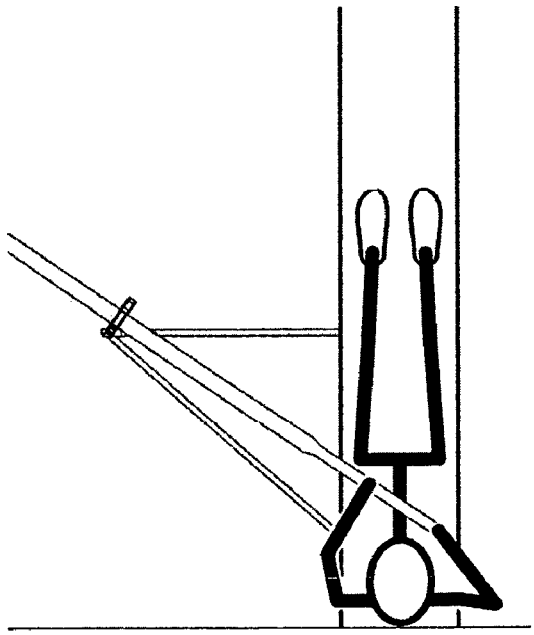
Figure 1b Prior Art
FIG. 1*b* is a diagrammatic overhead view of a sweep oarsman, using straight oar shaft and handle, at the end of a stroke, as prior art.

FIGS. 1*a* and 1*b* show how rowers using current oars (prior art) are limited by the fact that the extreme handle angles at the catch (FIG. 1*a*) and release (FIG. 1*b*) of each stroke.

Figure 2A:
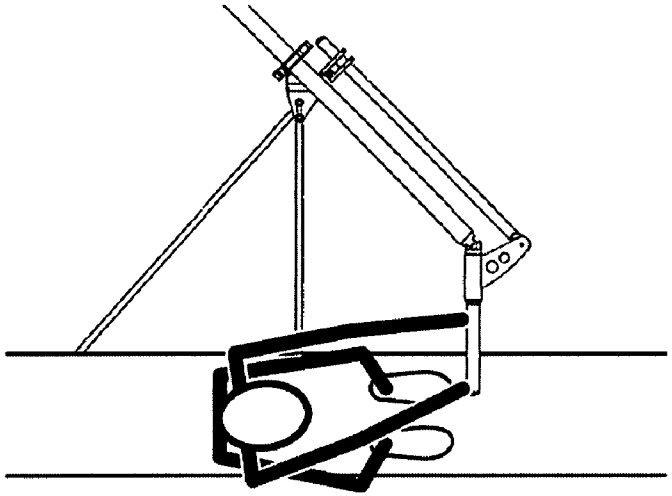
FIG. 2*a* is an overhead view of a sweep oarsman using articulating handle of the present invention at the beginning of a stroke.
Figure 2B:
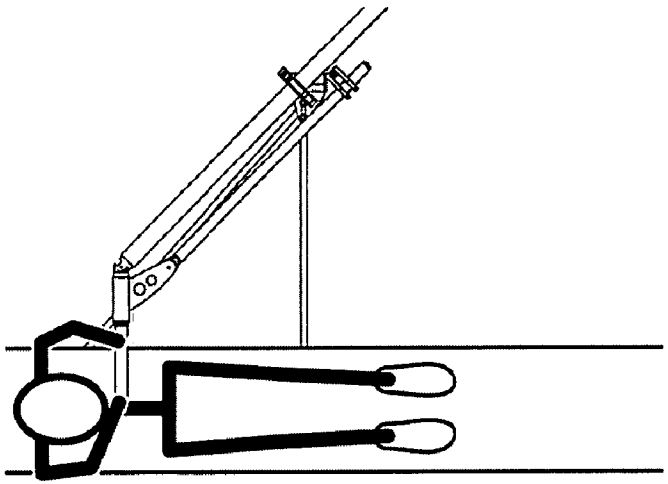
FIG. 2*b* is an overhead view of a sweep oarsman using articulating handle of the present invention at the end of a stroke.

The straight handle of the present invention and illustrated in FIGS. 2*a* and 2*b*, eliminates this angle by keeping the handle perpendicular to the shell and rower at every point in the stroke.

Figure 13:
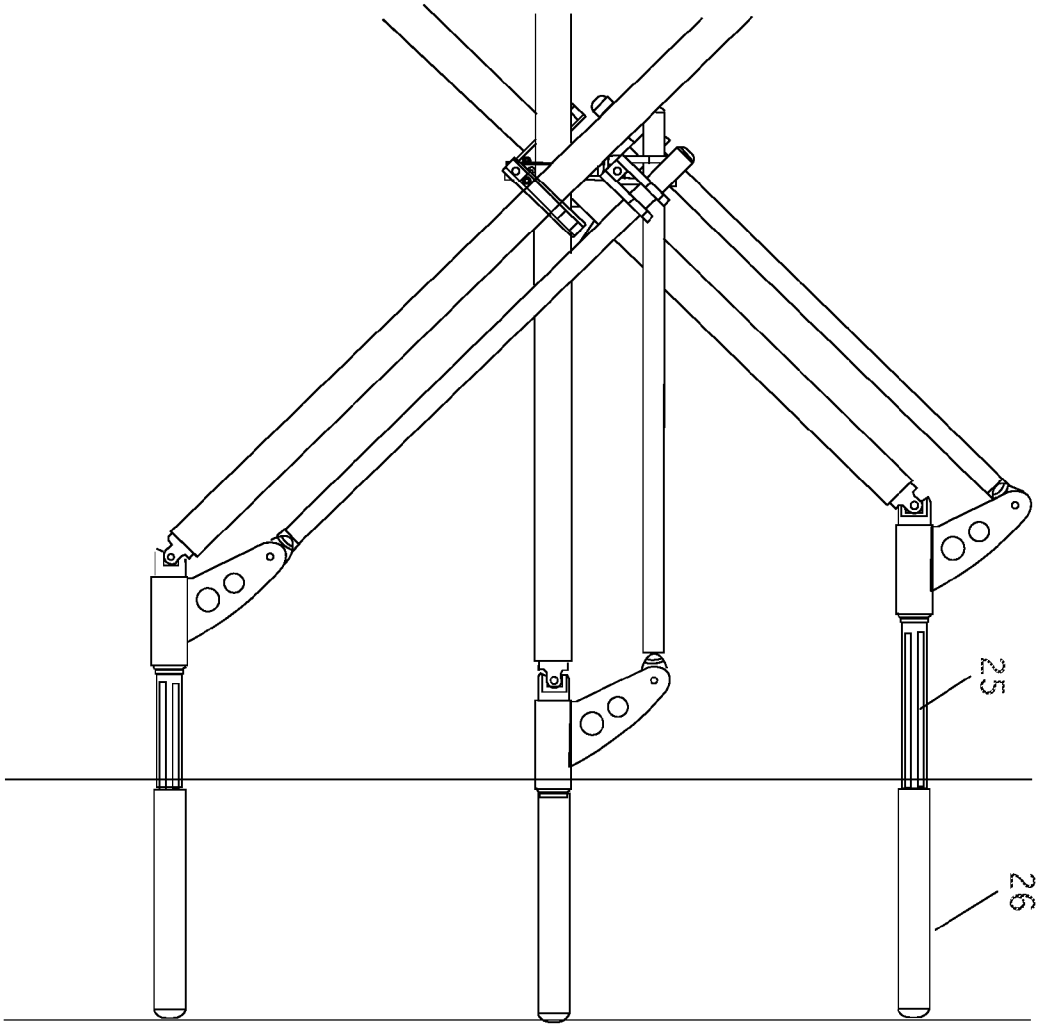
FIG. 13 is an overhead view of the articulated handle with sliding handle.

It should be noted that while the handle remains perpendicular (or near perpendicular—see below) throughout the stroke, it still travels in an arc as it is still moving around a single pivot point, the Oarlock. In the present invention, the rower has the option of using a stationary handle, which travels in an arc, or optionally, a sliding handle (see FIG. 13) that eliminates the arc by remaining in front of the rower at every point in the stroke.

The articulating handle 4 in the present invention can also be set to any constant angle more or less perpendicular to the shell. This can be done by varying the adjustment of the length of the parallel link relative to length of the oar shaft.

Assembly and Disassembly

The present invention is designed so that all major components can be easily disassembled for easy cleaning and repair.

Oar Assembly—Main Components

The present invention is an improved system for rowing sweep or sculls. It is constructed using a one or two link parallelogram structure to keep the handle perpendicular to the shell at all points in the stroke.

Referring now to FIGS. 3, 5, 7 and 8, the single parallel link system is shown. Here, the oar shaft 2 and blade 1 is similar in construction and function to current oars today. In fact, current oar shafts and blades can be retrofit to the present invention.

The purpose of the parallel link 5 is to keep the handle perpendicular to the shell at every point in the stroke. The shape of the parallel link 5 can be round, oval, triangular or any other shape that will provide adequate support for the handle 4. It is connected to the parallel link pivot/lock 10 as part of the oarlock assembly on one end, and to the knuckle assembly 3*a* on the other. The parallel link also serves to provide support the main oar shaft 2. The parallel link is called a parallel link because it always remains parallel to the oar shaft, as shown in FIGS. 2*a*, 2*b*, 3 and 4, e.g.

The oarlock assembly serves three primary functions. First, it acts as a pivot point for the main oar shaft 2. Second, it acts as a pivot point for the parallel link 5 for to move fore an aft. Third, it acts as a hinging point for the oarlock bracket 13 (see, FIG. 7) that moves up and down as a single unit. The oarlock design also limits the fore and aft free-play of the oar shaft 2 though the use of a collar 18 (see FIG. 8) that fits snugly within the oarlock 9. (See FIG. 7 dashed lines).

The oarlock collar 18 (see also, FIG. 8) is clamped around the main oar shaft 2 about ⅓ down from the handle. This component serves three purposes. First, its position longitudinally on the shaft determines the amount of leverage that can be applied to the oar. Second, its position axially around the shaft determines the angle of the blade's 1 "pitch" as it is pulled through the water. Third, it transfers the vertical force of the oar handle 4 to the blade 1 through the shaft 2 via the oarlock bracket-hinging 13 (see, FIG. 7). The oar collar 18 is mounted on the oar shaft 2 and is designed stabilize the oar shaft inside the oarlock, yet be free to rotate 90 degrees for feathering of the oar. The axial position of the collar on the shaft determines the oar blade's "pitch" or angle. When feathered, one of the horizontal sides of the rectangular collar 18 keeps the blade flat to the water. During the drive portion of the stroke, one of the vertical sides of the collar 18 is forced against the internal face of the oarlock 9 (see, e.g., FIG. 7).

The oarlock 9 holds the sides of the oar collar 18 like a cage so that the oar is not free to move up and down inside the oarlock as in current oars. Instead, this design insures that when the oar handle is raised or lowered, the force causes the entire oarlock hinge bracket 13 to pivot or hinge up and down, keeping the oar shaft, parallel link and the rest of the oar assembly moving up and down as a unit.

Two concepts are related to the placement of the oarlock. "Outboard" is the length of oar shaft outboard of the oarlock. Shortening the outboard is equivalent to moving to a lower gear resulting in shorter and easier strokes. Outboard can be adjusted by moving the oar collar 18 up or down the length of the shaft, effectively changing the gearing. In the present invention the oar shaft 2 under the collar is etched with vertical lines to aid in adjusting outboard.

The second outboard adjustment is "pitch". "Pitch" is the angle of the blade in the water. Pitch can be adjusted in the present invention by adjusting the position of the collar 18 axially, relative to the blade. Horizontal lines on the oar shaft 2 aid in adjusting blade's pitch. The oar collar's 18 adjustment is affected by loosening the cap screw, resetting its position to achieve the desired outboard and pitch and then tightening the cap screw to lock it into position.

Figure 5:
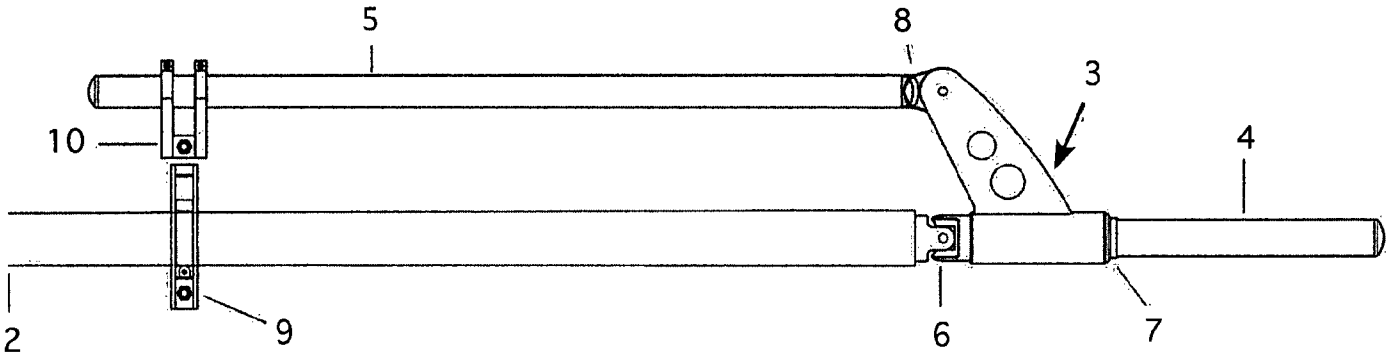
FIG. 5 is a detail view of the parallel link with collar-type length adjustment.
Figure 11:
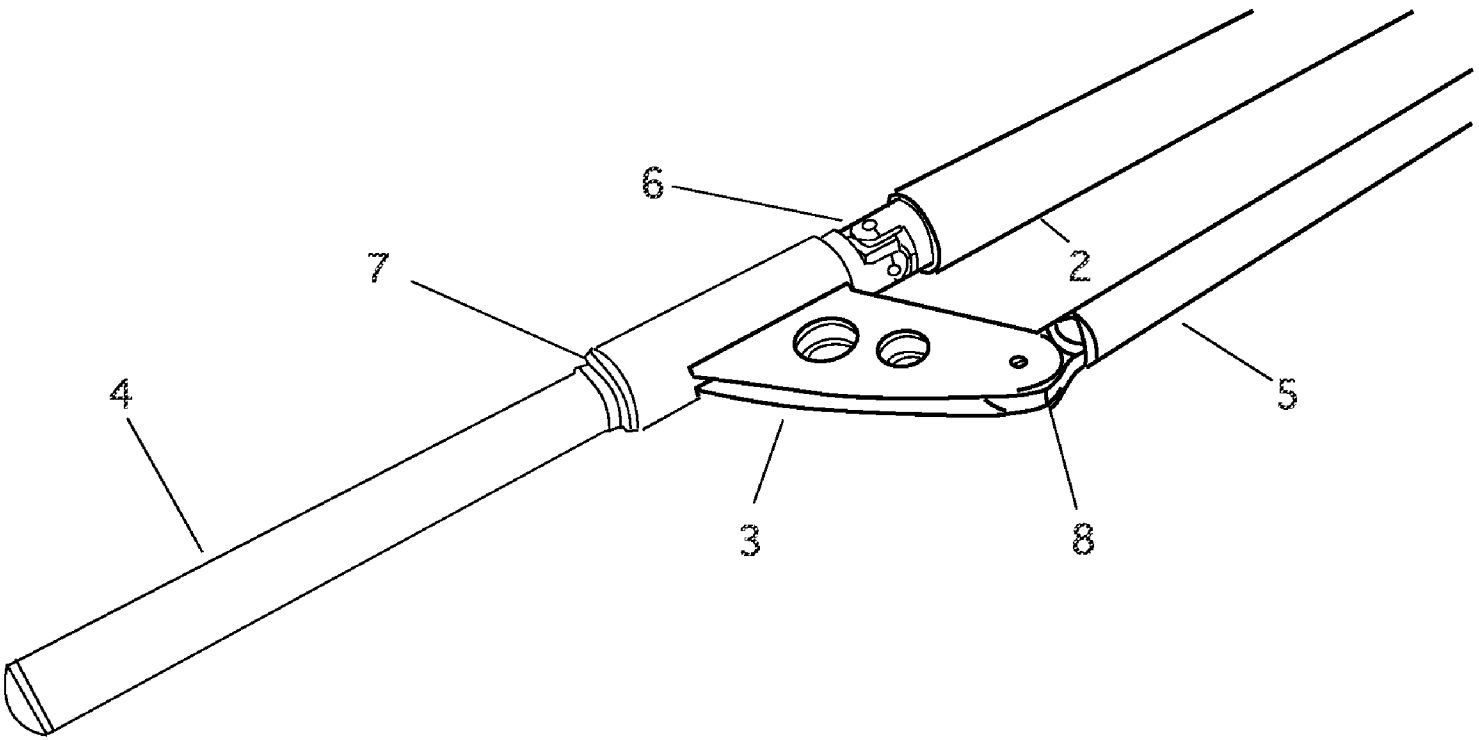
FIG. 11 is a detail view of the oar handle and knuckle

Referring now to FIGS. 3, 5 and 11, the knuckle assembly 3 houses the base of the oar handle 4 and features an arm with a pivot 8 that connects to the parallel link 5. In addition to supporting the oar handle 4, the knuckle is also connects the oar shaft (through the handle 4) to the parallel link 5.

The knuckle assembly 3 consists of a tube 7 that fits over the handle 4 as shown in FIG. 11, and an integrated arm 3*a* with a pivot hole on its end, which connects to the pivot member 8. The tube 7 holds the base of the handle in place, while the arm holds the end parallel link 5. The knuckle assembly, in conjunction with the oarlock assembly, performs the critical function of keeping the handle perpendicular to the shell at every point in the stroke. The knuckle can be composite, metal or a combination thereof.

Figure 12:
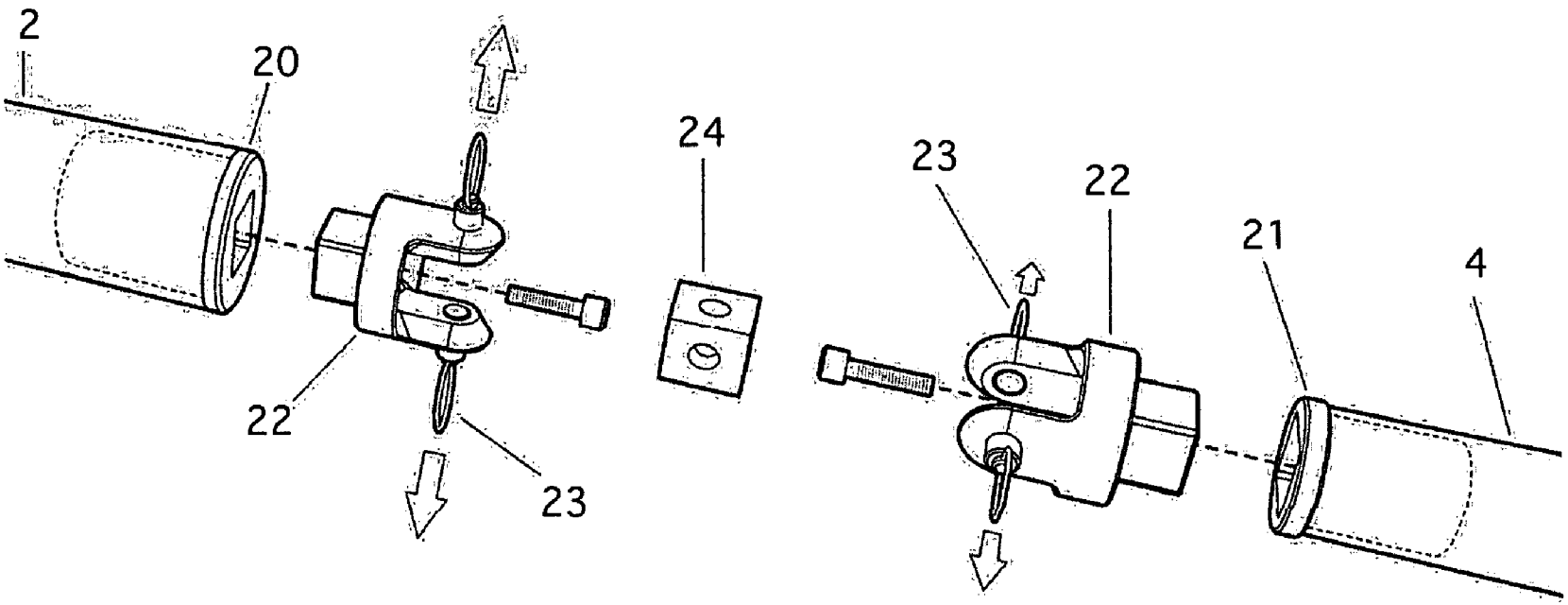
FIG. 12 is an exploded view of the universal joint.

A universal joint 6 is positioned between the end of the oar shaft 2 and the handle 4 allows for the feathering and articulation of the oar. Thus, the universal joint and the ball joint, discussed below, can be considered as a means for feathering the oar. The U-Joint is mounted in alignment with the pivot 8 of the parallel link 5. The U-joint is needed to allow for "feathering" (turning of the blade 90 degrees during the return portion of the stroke) and articulating (keeping the handle at a constant angle relative to the shell throughout the stoke). As shown in FIG. 12, the universal joint is attached to the oar shaft by means of a plug 20 and 21 that is inserted into the shaft and permanently fixed with epoxy. Each side 22 of the universal joint slides over the end of this plug 20 and 21 that and is held in place by a key and a threaded cap screw. Block 24 is then attached to the two parts of the U-joint to connect them for operation. The universal joint can be composite ore metal or a combination thereof.

The handle 4 is attached to the universal joint 6 on one end, goes through the knuckle sleeve 7 and held in place by a handle bushing stop that formed on the handle. The stop limits the travel of the knuckle on the handle as shown. The handle rotates freely inside the knuckle assembly to allow for feathering. Handles can be easily changed for different sizes, shapes and textures without changing the rest of the oar. The handle can be composite, metal, wood or a combination thereof.

The present invention includes the option of a sliding handle. The purpose for the sliding handle is to eliminate the arc of the perpendicular handle from the beginning of the stroke to the end of the stroke. See, FIG. 13.

The preferred method for constructing the sliding handle uses a telescoping outer tube 26 over a fixed inner tube 25. The inner tube b25 has grooves (square, round, triangular, etc.) that mate with outer tube bosses (of the same shape) and run the length of the tube. Sizes, shapes and location of groves and matching bosses can be used to insure that sliding handle is always put on exactly the same way. Note: ball bearings (not shown) can be used instead of bosses to further reduce friction.

This boss and groove feature is important as it allows the outer handle to slide easily along its length, but prevents it from turning around its axis. This design insures that the rower still have control over the orientation of the blade on the power stroke and the return stroke when feathering.

Figure 6:
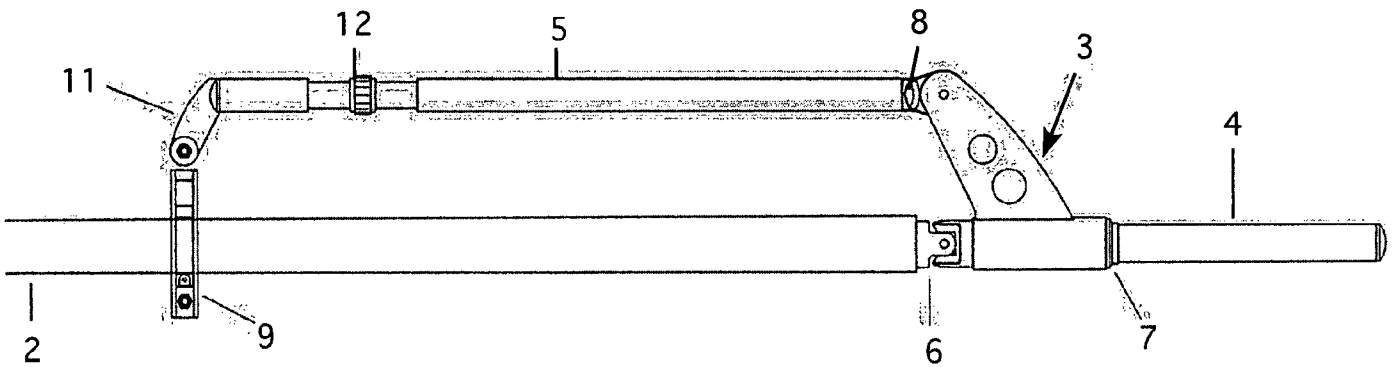
FIG. 6 is a detail view of the parallel link with turnbuckle-type length adjustment.

Referring now to FIGS. 5 and 6, two methods of adjusting the system are shown.

The first and preferred method is to use the parallel link 5, which pivots on the knuckle arm 8 on one end and slides through the adjustable parallel link pivot/lock 10 on the other. Once proper adjustment has been achieved, the pivot/lock bolts 10*a* (on the pivot lock—see FIG. 7) are tightened around the parallel link.

The second method is to fix both ends of the parallel link as shown in FIG. 6. In this embodiment, one end of the parallel link pivots on the knuckle arm 8 and the other end is fixed to the parallel link pivot/lock 11. Adjustment is achieved with a turnbuckle type device 12 along the length of the parallel link. In this system, (female) tubes form the ends of the parallel link and connect together through a (male) turnbuckle 12 link in the middle. One end of the turnbuckle link has right-hand threads, the other, left-hand threads. When the turnbuckle link is turned one way, the parallel link is lengthened. When turned the other way, the parallel link is shortened. Threaded rings are used to lock the turnbuckle link at a set length.

The description above is for the preferred Single Link System (FIG. 3) there is one Parallel Link is adjustable so that is can remain parallel to the main oar shaft when the "inboard" or inside length of the oar, is adjusted.

FIG. 4 shows the double link system in which there are two parallel links 5. As shown, this system adds a second parallel link 5 with all of the associated hardware. Note that there are two knuckles 5 attached to the knuckle sleeve 7. There are also two parallel link pivot/locks 10 attached to the oarlock 9. In this system, each of the external parallel links 5 is adjusted in a way similar to that of the single tube in the single-link system.

Outrigger Construction

Figure 7:
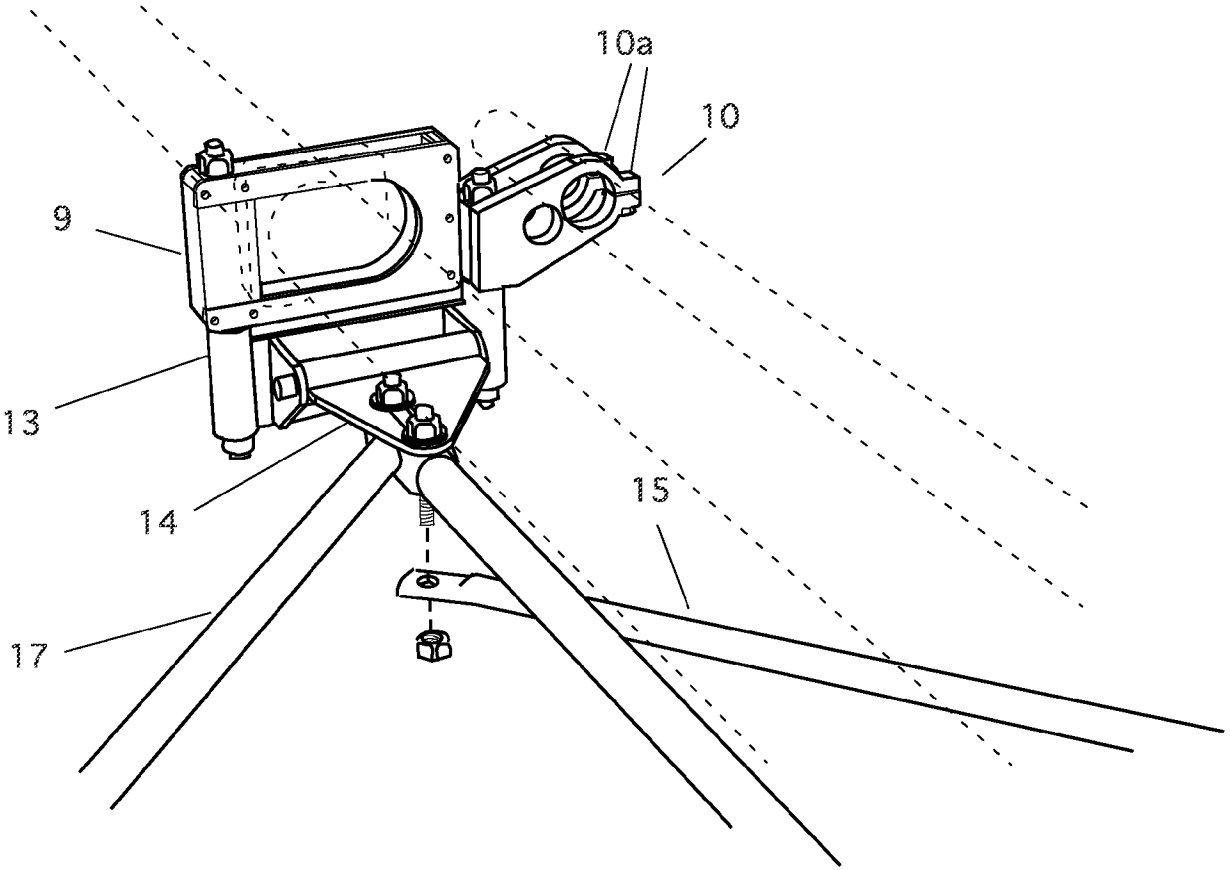
FIG. 7 is a detail view of the oarlock-main shaft and parallel link pivot/lock.
Figure 8:
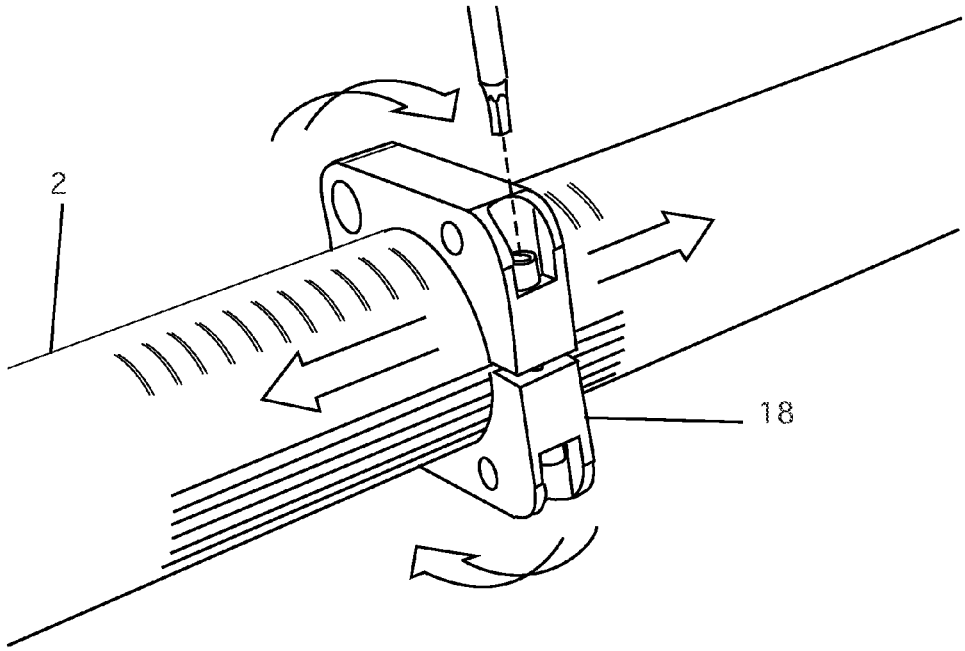
FIG. 8 is a detail view of the adjustable collar on an oar shaft.
Figure 9:
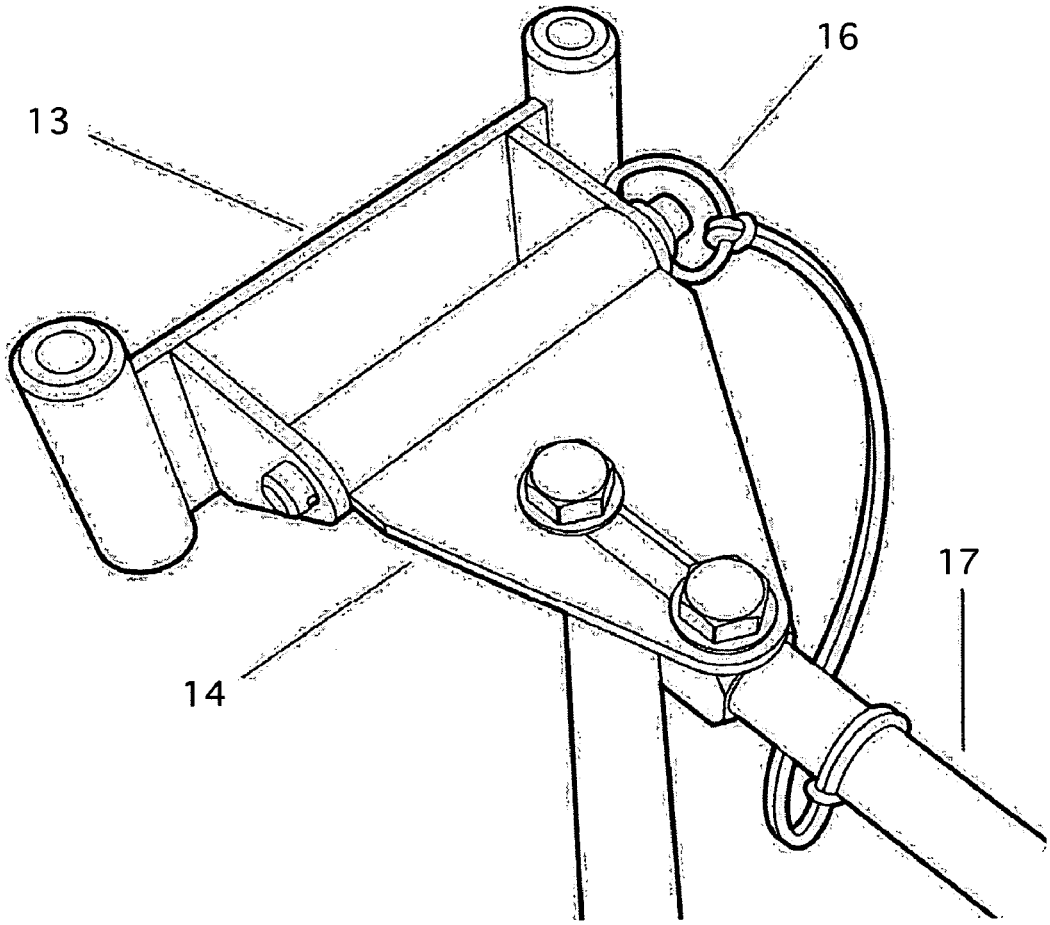
FIG. 9 is a detail view of the outrigger adaptor (sweep) with quick release pin.

For sweep type oars, adaptors are needed to mate the current invention to various style outriggers that are currently in use on sweeps. Referring now to FIGS. 7 and 9, an outrigger main stay bracket 17 is found on many sweep shells (as well as some sculls). The outrigger mounting bracket, part 14, attaches to the main stay bracket 17 with two bolts and nuts as shown in FIG. 7.

Most sweeps and some sculls use outriggers with backstays that normally mount on the top of fixed oarlock pins to provide additional strength. In the present invention the fixed oarlock pins are replaced with the Outrigger Mounting Bracket. (Part #14) The backstay is then moved underneath the outrigger as shown in FIG. 7, Part #15.

FIG. 9 shows a quick release pin with tether 16, which connects the oarlock bracket 13 with the outrigger mounting bracket 14. The tether provides added security for the outrigger mounting bracket. The oarlock assembly features a quick release pin-tether 16 that allow a fast and convenient way to attach and detach the oarlock assembly to and from the rowing shell.

Figure 10:
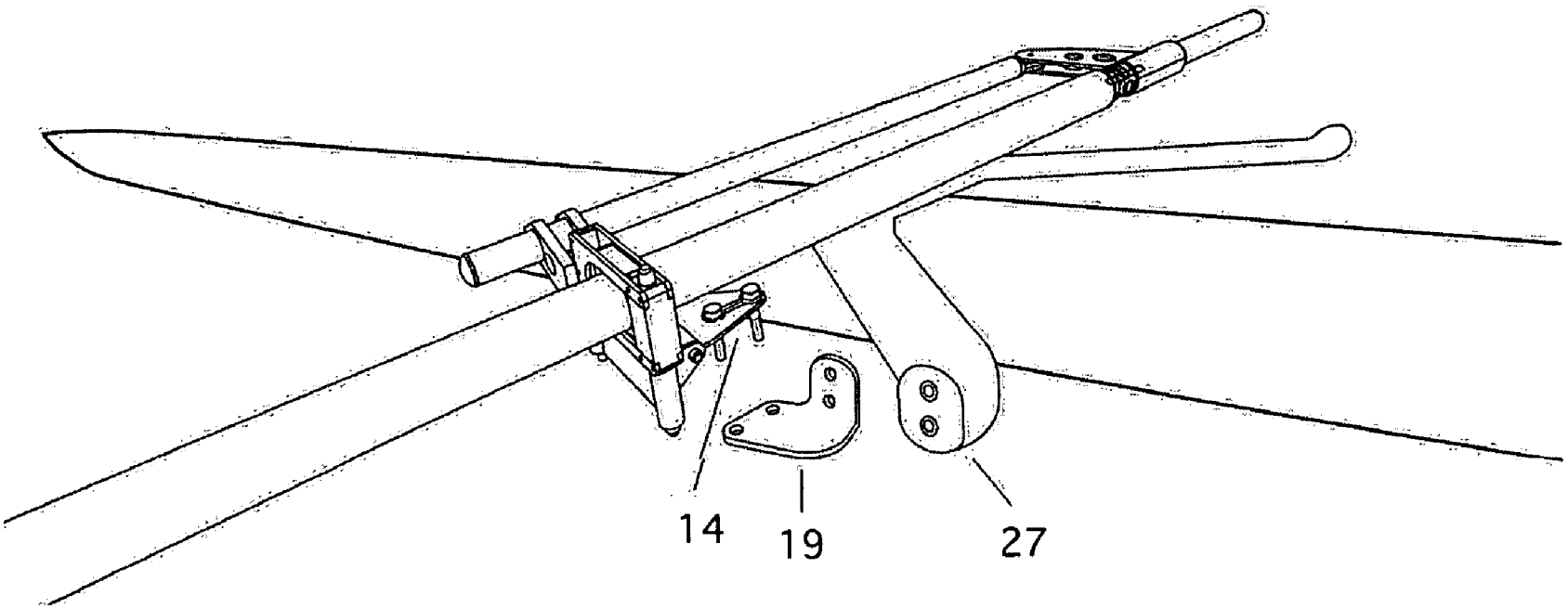
FIG. 10 is a detail view of the outrigger adaptor (scull).

For sculls, a less common outrigger configuration, illustrated in FIG. 10 by 27, is an example of the variety of outrigger designs that can be found on all shells, especially sculls. Special brackets or adaptors 19, for example, are needed to mount the outrigger mounting bracket 14 to them.

Alternative Outrigger Design

There are almost as many different designs for outriggers as there are different shells. For this reason, different adaptors are required. Some shells, especially sculls, have outriggers that support the oarlock from the side. See, FIG. 10, numeral 19. These outriggers will require a different sort of adaptor to mount the Oarlock Assembly.

Outriggers can be adjusted closer to the shell or farther out (to adjust "spread") by loosening up the attachment bolts that hold the Outrigger Mounting Bracket 14 to the Outrigger Main Stay/Bracket 17.

Material for the oarlock to outrigger adaptors can be composite, metal or a combination thereof.

Method of Assembly of the Preferred Embodiment

1. Start with an oar shaft 2 with a blade 1 mounted on the end.

2. If retrofitting an existing oar, cut the existing handle off at its base.

3. Slide collar 18 about ⅓ down shaft and tighten the clamping bolt.

4. Scribe horizontal and vertical lines on oar shaft 2 under collar 18 to assist in adjusting the "outboard" (longitudinal) and "pitch" (axial).

5. Insert and epoxy an oar shaft plug, 20 into the end of oar shaft 2 opposite the blade end.

6. Insert a male key of U-joint half 22 into female key of oar shaft plug 20

7. Insert a center-mounted cap screw through the center of u-joint half 22 and tighten it to oar shaft plug 20.

8. Epoxy an oar handle 21 into open end of handle tube 4.

9. Insert male key of U-joint half 22 into female key of handle plug 21.

10. Insert a center-mounted cap screw through center of U-joint half 22 and tighten to handle plug 21.

11. Using U-joint pins 23 join both halves of U-joint 22 to the center block 24

12. Slide oar handle 4 through knuckle sleeve 3 until the removable U-joint pins 23 holding the U-joint center block 24 are exactly perpendicular to the parallel link pivot hole on the end of the knuckle arm 3.

13. Holding the handle firmly in this position, slide the handle bushing stop down the handle to the top of the knuckle sleeve 7; epoxy the bushing stop to the handle.

14. Open the oarlock-main shaft 9 and insert the collar 18. Close the oarlock 9.

15. Attach the parallel link rod end 8 on the parallel link 5 to the knuckle arm 3 pivot hole using a removable locking pin (not illustrated).

16. Slide the other end of the parallel link 5 though the parallel link pivot/lock adjustable 10 or 11 until the parallel link and the oar shaft 2 are parallel.

17. Remove the existing oarlock pin from the outrigger main stay 17.

18. Mount the outrigger mounting bracket 14 to the outrigger main stay 17.

19. Mount the outrigger fore stay 15 to the bottom of the outrigger mounting bracket 14 and the outrigger main stay/bracket 17.

20. Attach the oarlock bracket-hinging 13 to the outrigger mounting bracket 14 using quick release pin with tether 16.

21a. For the stationary assembly, which is semi-permanently mounted to the shell via the outrigger, the outrigger mounting bracket 14 stays mounted to the outrigger main stay/bracket 17 and the outrigger fore stay 15.

21b. For the mobile assembly, the oar assembly (the blade 1 shaft 2, knuckle 3 handle 4 and parallel link 5 are mounted to the oarlock 9 and parallel link pivot/lock 10 or 11. The last two parts are mounted to the oarlock bracket hinging 13. The mobile assembly is essentially the oar and the oarlock as one integrated assembly. The mobile assembly connects to the stationary assembly via the quick release pin 16.

Operation and Use

The rower gets in the shell in the normal way. The stationary assembly is already mounted on the shell. Once seated, the first task is for the rower to attach the mobile assembly to the stationary assembly with the quick release pin 16.

The rower positions the oarlock bracket 13 over the outrigger main stay/bracket 17. Once aligned, the rower takes the tethered quick release pin 16 and inserts it in the hinge until it locks in place, thereby joining the mobile assembly to the stationary assembly. The invention is now ready to row.

The invention is similar in use to current oars in that there are essentially four parts to the stroke: 1.) catch, 2.) drive, 3.) release and 4.) return.

1.) Catch—the rower stretches out his or her arms while bending their knees and sliding towards the foot stretchers. When fully extended (shins straight up, arms extended, the rower unfeathers the oars by lifting the wrists at the same time raising the handle 4 causing the blade to submerge about a foot under the surface of the water.

2.) Drive—the rower pushes off the foot stretchers and drives away from the stern (which he is facing) first by driving with the legs and then, as the legs become fully extended, smoothly transitioning to upper body power to complete the stroke.

3.) Release—at the end of the drive the rower smoothly pushes down on the handle 4 cleanly removing the blade 1 from the water while dropping the wrists. This causes the blade to feather, or turn so that it is flat to the water for the return stroke.

4.) Return—the rower uses his legs to pull himself or herself back into the compressed starting position at the beginning of the stroke.

As discussed above, the length of the oar shaft is one of several ways to control leverage. Other dimensions affecting this leverage (or "gearing") include the size and shape of the blade, the spread (distance from the centerline of the boat to the oarlock), inboard (distance from the handle end to the collar), and the position of the oarlock and the position of the collar (pivot point). These variable dimensions combined form the major dimensions affecting efficiency in leverage or gearing and one of the ways to change gearing is to adjust the length of the shaft.

In traditional rowing shells, the outriggers provide a means for adjusting the spread by moving the oarlock in or out. Inboard adjustment is effected by moving the collar 18 (the pivot point) up or down the oar shaft. Some oars also provide a means to adjust handle length 5-10 cm, which provides for additional adjustment. However, when handle length is adjusted to the maximum there is often an accompanying loss of inboard adjustment (i.e., position of the collar 18 relative to the sleeve).

A traditional oar's length is measured from the leading edge of the blade to the end of the handle. In the present invention, shaft length measurement is taken from the edge of the blade to the flex-joint. The handle is not included in the shaft length when calculating leverage. For this reason shafts of the instant invention should be approximately 20% larger than traditional oars to maintain the same gearing.

In addition to the other points of adjustment, it is advantageous to be able to adjust the shaft length to either increase or decrease the rower's perceived load. With traditional oars, increasing the outboard (the proportion of the oar outside of the oarlock) automatically decreases the inboard. For example, in a headwind, the shaft should be shortened to lower the gearing and make it easier for the rower to pull on the handle. In a tailwind, the opposite holds true.

Proper blade pitch, the angle of the blade relative to the oarlock pin, is also important in keeping the blade at the right height during the drive or power stroke. The present invention allows the rower to adjust blade pitch to any desired angle. This is accomplished by first making sure the flat part of the collar 18 rests flush against the flat part of the oarlock and then rotating the oar shaft in the collar until the desired blade pitch is achieved. Once the pitch is set, the clamp around the collar is tightened down.

Figure 14:
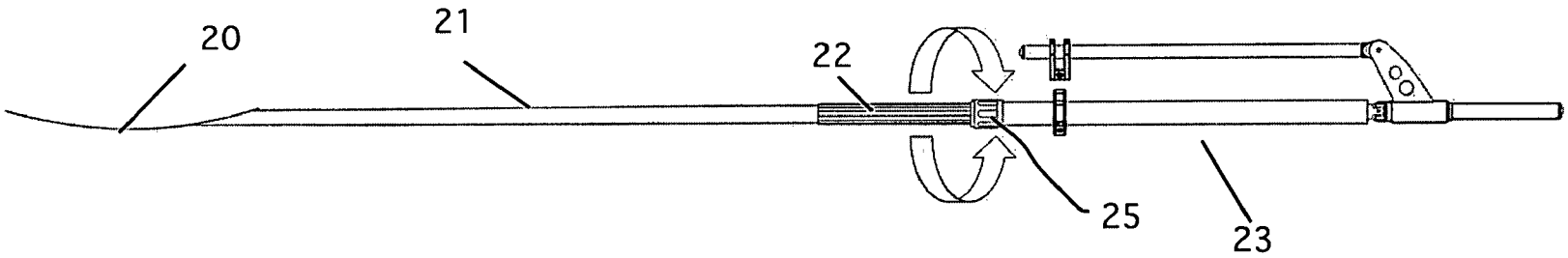
FIG. 14 is a side view of an oar shaft having an adjustable length fully extended.
Figure 15:
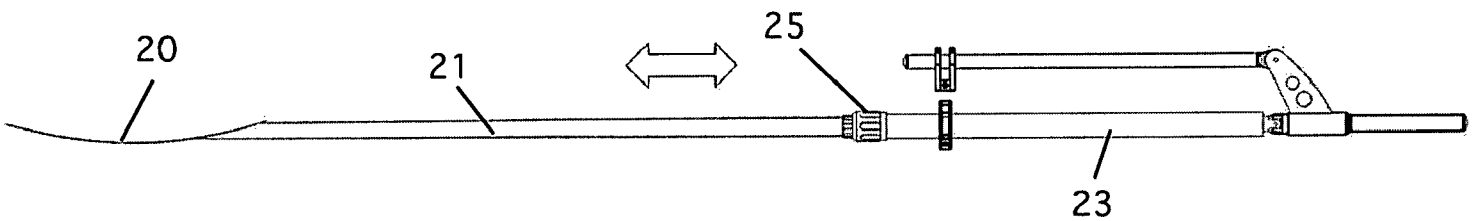
FIG. 15 is a side view of an oar shaft having an adjustable length fully retracted.
Figure 16:
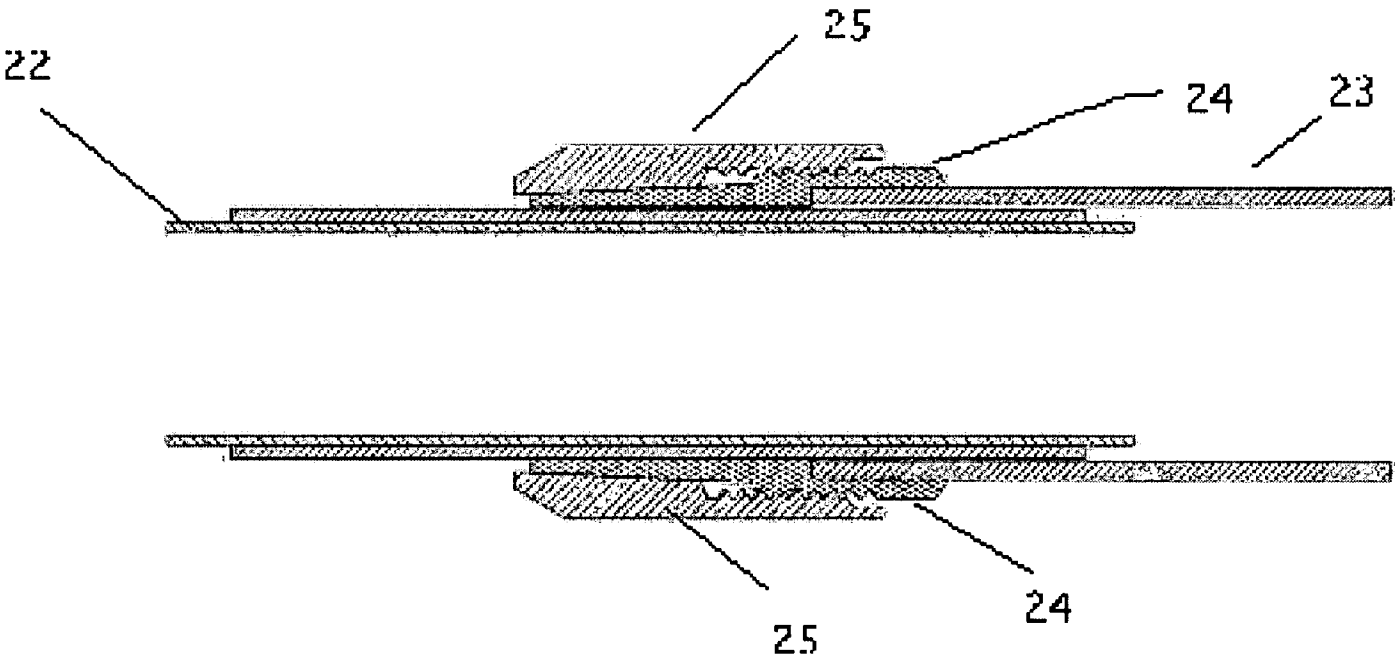
FIG. 16 is a detail cross-sectional view of the locking mechanism for the adjustable shaft.

FIGS. 14-16 show another embodiment of the invention. In these figures, an adjustable shaft is disclosed. The adjustable shaft components are designed to insure that the pitch does not change by having one shaft rotate relative to the other. This positive lock, that prevents twisting, is achieved via the interlocking channels (fluting) located inside the outer shaft (the tube closest to the handle) and outside of the inner shaft (the shaft closest to the blade). In the preferred embodiment, the fluting is an integral part of the carbon fiber shafts. Benefits over existing oar design include: adjustability, interchangeability and transportability.

Referring now to FIGS. 14-16, details of the adjustable shaft are shown.

FIG. 14 is a side view of an oar shaft having an adjustable length fully extended. The oar in this embodiment is preferably blade 20 made of a carbon fiber or composite over foam that is adhered to the oar shaft 21. The Oar shaft (Carbon fiber preferred) is tapered up until the beginning of the fluting 22.

The fluting 22 is molded into the last 24" of the oar shaft 21. The diameter of the fluting is sized to fit snugly into the upper shaft 23. The lower shaft is delineated to indicate the total length of the shaft from the end of the blade to a set of measurement marks (not shown). This allows the user to quickly select the desired length of the oar shaft. A male threaded collar 24 (carbon fiber preferred) is attached to the end of the upper shaft 23 as shown in FIG. 16. The inside diameter of the upper shaft (carbon fiber preferred) is sized to fit snugly over the fluting 22 on the Lower Shaft. A knurled locking ring 25 (carbon fiber preferred) is threaded onto the male threaded collar 24. When tightened, knurled locking ring locks the two parts of the oar shaft together for use. In FIG. 14, the lower shaft 21 is extended to lengthen to oar. FIG. 15 is a side view of an oar shaft having an adjustable length fully retracted. In this view, the lower shaft is fully pushed into the upper shaft to provide a shorter oar. The knurled nut and the shaft shapes can be considered as a "means of adjusting the length of the oar shaft".

FIG. 16 is a detail cross-sectional view of the locking mechanism for the adjustable shaft. As discussed above, the knurled locking ring 25 is shown threaded onto the male threaded collar 24.

To use the adjustable system, first, the end of the lower shaft 21 is aligned with the open end of the upper shaft 23 taking care that the blade pitch is at the desired angle. Next, the lower shaft is inserted into the upper shaft until it is at the proper length as indicated by the measurement marks (not shown). Once the oar shaft is at the desired length, the knurled locking ring is tightened around it. The knurled locking ring (KLR) 25 works in conjunction with the male threaded collar (MTC) 24. As the KLR is tightened, the MTC is compressed, thus tightening the upper shaft around the lower shaft. When the KLR is loosened, the MTC is released, thus loosening the upper shaft around the lower shaft. The KLR and MTC are designed to be wide to spread the load and allow the lock to be operated by hand, without the need for any tools.

As discusses above, to enable the user to feather the oar, a u-joint is installed between the handle and the oar shaft. A common u-joint serves the purpose as it provides a strong mechanical coupling that can efficiently transfer energy in all directions. Common U-joints have one limitation: they can travel only in a total arc of approximately 90 degrees. It is desirable, however, to have a flexible coupling that can achieve an arc up to 125 degrees of total arc.

Another embodiment of joint in this invention is a new design that combines a flexured u-joint for its much larger arc with an internal ball and socket to provide the mechanical strength to deal with the fore and aft forces in this particular application.

The ball and socket makes a solid fore-aft connection between the oar handle and oar shaft for the power stroke and return stroke.

The flexure u-joint makes a solid tortional connection between the handle and oar shaft for feathering the blade at any point in the stroke (typically at the beginning and end). The socket has been designed to permit up an arc up to 130 degrees. The joint is made of stainless steel and aluminum components for strength and durability in a salt-water environment. It is also designed to be easily disassembled for cleaning and replacing worn parts. The new ball joint is shown in FIGS. 17-20.

Figure 17:
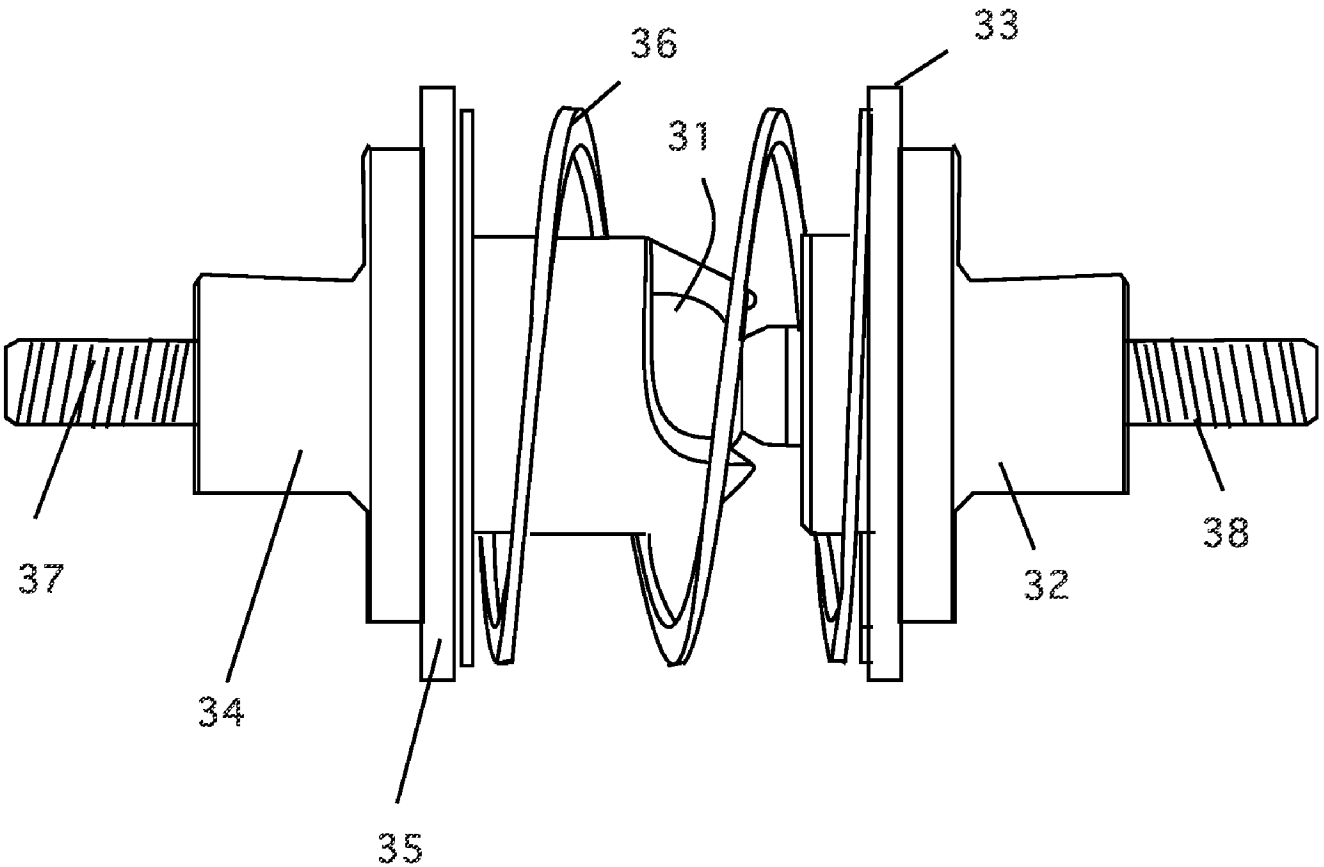
FIG. 17 is a side view of a new ball joint for use with the invention.

FIG. 17 is a side view of a new ball joint for use with the invention.

Here, the ball joint 30 is shown assembled. The major components of the ball joint include a ball 31 forms the center of the joint. A ball base plate 32 is positioned at one end of the joint as shown. A ball mounting plate 33 is attached to the ball base plate 32 as described below. An inner socket 34 is positioned at the other end of the joint. An outer socket 35 is attached to the inner socket 34, as discussed below. Finally, a spring 36 is positioned around the ball joint, as shown.

Figure 18:
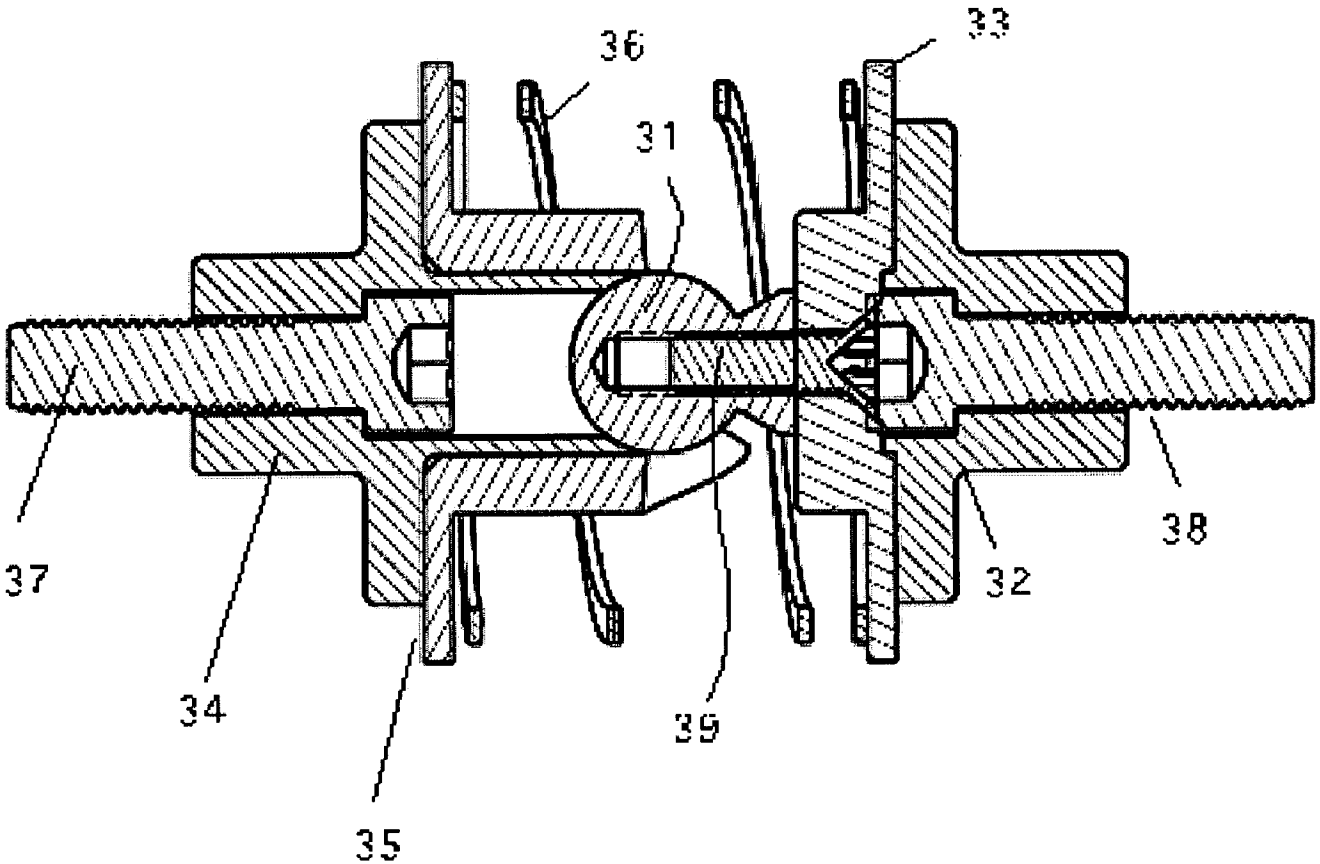
FIG. 18 is a side cross-sectional view of a new ball joint for use with the invention.

FIG. 18 is a side cross-sectional view of a new ball joint for use with the invention. Here, the major components discussed above are shown as assembled.

Figure 19:
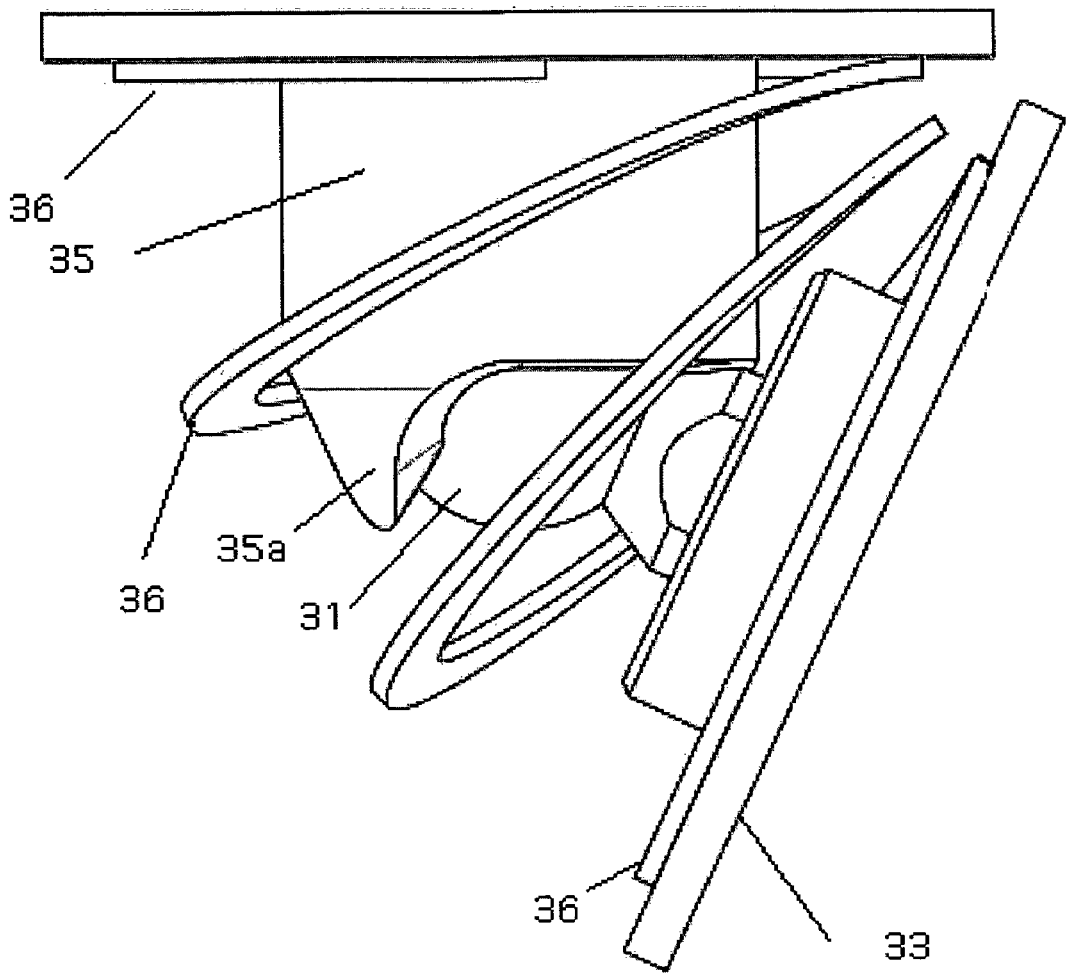
FIG. 19 is a detail view of the ball joint in a flexed position.

FIG. 19 is a detail view of the ball joint in a flexed position. Here, the ball mounting plate 33, the ball 31, the outer socket 35 and the spring 36 are shown. Note, that the spring is attached both the outer socket and ball mounting plate.

Figure 20:
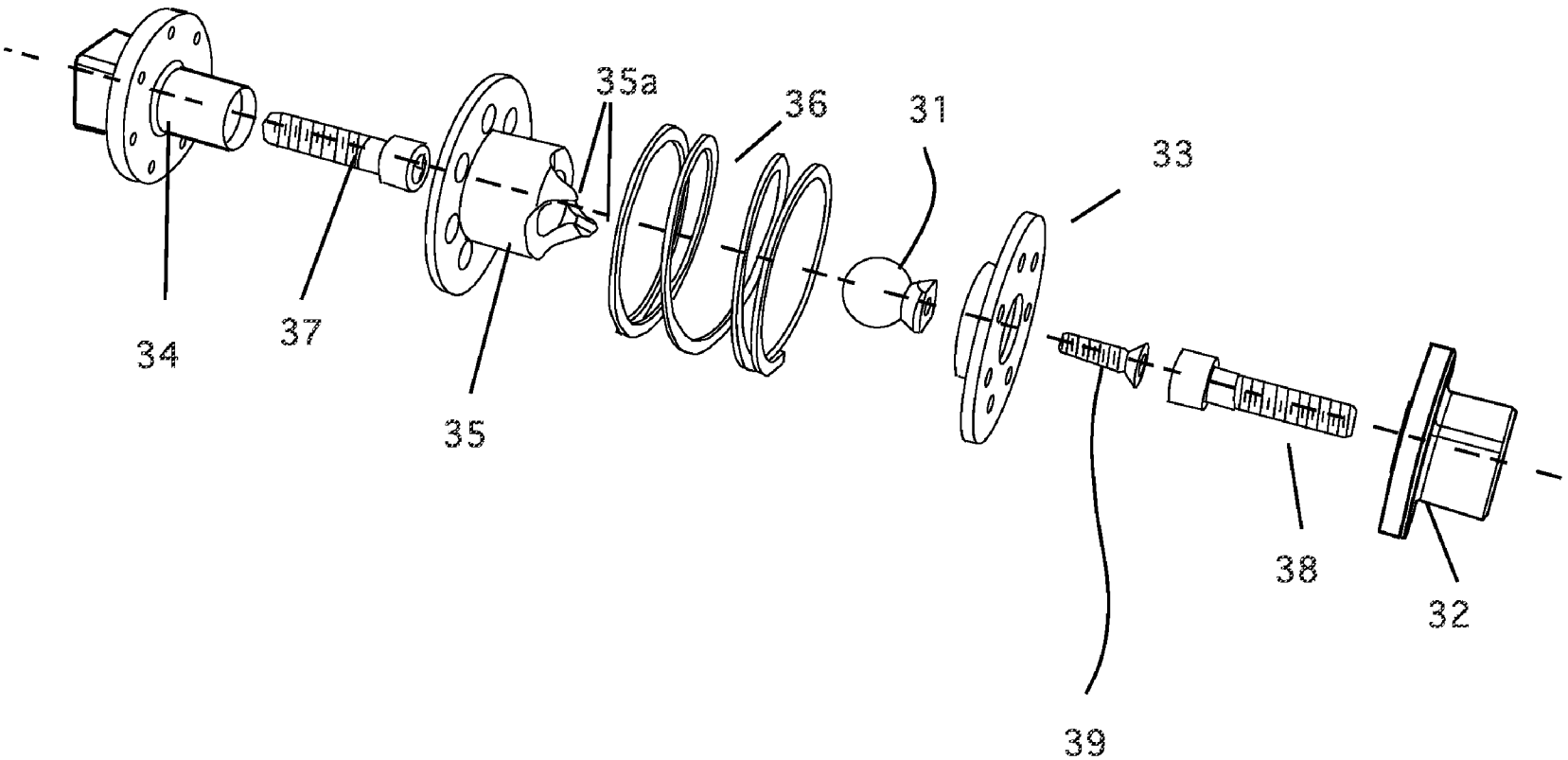
FIG. 20 is an exploded view of the new ball joint.

FIG. 20 is an exploded view of the new ball joint. The joint is assembled as follows: the inner socket 34 is bolted to oar shaft end (opposite blade) using a cap screw 37. The ball base plate 32 is bolted to handle end with cap screw 38. The ball 31 is inserted into outer socket 35 so that the flat part protrudes through the "ears" 35*a*. The outer socket 35 is screwed to inner socket 34 providing top and bottom support for the ball 31. The spring 36 is placed between outer socket 35 and the ball mounting plate 33.

A bolt 39 is inserted through the bottom of ball mounting plate 33 and screwed into base of ball 31. The spring 36 is attached to outer socket 35. The spring 36 is also attached to ball mounting plate 33. The ball mounting plate 33 is screwed to ball base plate 32 using common fasteners (not shown). When assembled, the joint fits between the oar shaft and the handle.

Figure 21:
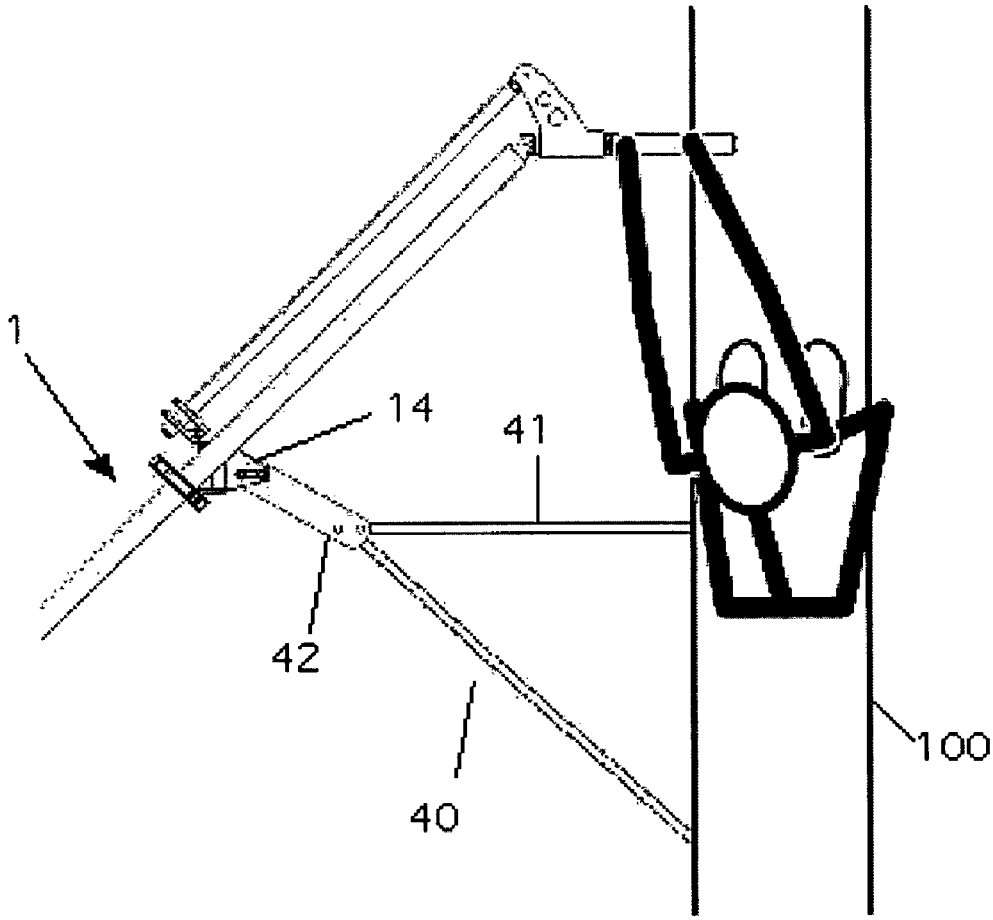
FIG. 21 is a diagrammatic top view of an outrigger extender in place on a shell.

FIG. 21 is a diagrammatic top view of an outrigger extender in place on a shell. The purpose of the outrigger extension is to move the oarlock mount outboard and aft of the location of a traditional oarlock. In the preferred embodiment, outriggers that have the oarlock mounting bracket further out and aft of what is now normal to accommodate the present invention are used. The outrigger extension, therefore, is a device that is used to adapt the present invention to outriggers designed for traditional oars. By moving the outrigger and therefore the oarlock towards the stern of the boat it has the effect of shifting a greater percentage of the blade's time in the water to the beginning of the stroke where the hydrodynamic lift is greatest (stages 2 & 3) and reduces the amount of time the blade in the water at the last part of the stroke (Stage 4) when the lift is either neutral or possibly even negative.

The outrigger extension is a device whose purpose is to add length to outriggers used with traditional oars. The preferred embodiment is that the outriggers are designed and built using the increased spread as called for by the present invention.

Referring now to FIG. 21, a shell 100 is shown with outrigger 40 and 41 attached. Normally, as discussed above, the outriggers would be sufficiently long to reach the outrigger mounting bracket 14. When using conventional outriggers, a sturdy bracket 42 that can be fabricated out of bar stock, tubes, or box stock is positioned between the outrigger 40 and 41 and the outrigger mounting bracket 14. The preferred material for the bracket 42 is aluminum. The outrigger extension has no moving parts. Stainless steel bolts hold the outrigger extension to the outrigger on one end and the oarlock bracket on the other. The outrigger extension must be sturdy enough so that there is no flex up and down or fore and aft. The preferred embodiment is built to be light and provide some measure of adjustability.

Outrigger extensions are fabricated to different lengths to provide the rower with additional adjusting capabilities (spread). Adjustments to the spread (distance from one oarlock to the other on a scull or from the oarlock to the centerline of the shell on a sweep) provide three times the effect on leverage as adjustments to the inboard (distance from the oar collar to the end of the handle).

Finally, as noted above, the blade 1 is interchangeable. That means it can be interchanged as desired. Variables such as weather, water conditions, rower size, weight, strength and personal preference affect the size and shape of the correct blade for any given situation. This feature permits the user to have many different combinations of blades and shaft lengths without having to buy a fixed length, fixed blade oar for each variable. Additionally, the removable shaft/blade assemblies can be built with different stiffness characteristics. This variable can be controlled with the type and thickness of the carbon or fiber tube walls. Stiffness may also be adjusted with internal foam of various densities. Removable shaft sections can also be sealed on the end or filled with foam to permit them to float in the event that they were dropped in the water.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. A rowing oar system with articulating handle for keeping the handle perpendicular to a shell comprising:

a) an oar shaft having two ends;

b) a blade attached to one of said two ends of said oar shaft;

c) an oarlock assembly adjustably attached to said oar shaft;

d) a handle hingeably attached to the other end of said oar shaft;

e) a knuckle assembly, operably attached to said handle;

f) a parallel link; pivotably attached to said knuckle assembly and to said oarlock assembly; and g) a means for feathering said oar during a rowing stroke, in operable communication with said handle and said oar shaft.

2. The rowing system of claim 1 wherein the means for feathering said oar comprise a ball joint, operably installed between said handle and said oar shaft.

3. The rowing system of claim 1 wherein the means for feathering said oar comprise a universal joint, operably installed between said handle and said oar shaft.

4. The rowing system of claim 1 wherein the oar shaft has an adjustable length and further includes a means for adjusting the length of said oar shaft.

5. The rowing system of claim 1 wherein the handle is slidably attached to said oar shaft.

6. The rowing system of claim 1 further comprising an outrigger; and a means for attaching said outrigger to said oarlock assembly.

7. The rowing system of claim 6 wherein the means for attaching said outrigger include an outrigger extension bracket.

8. The rowing system of claim 1 wherein the blade is interchangeable.

9. The rowing system of claim 4 wherein the means for adjusting the length of said oar shaft include a locking mechanism to secure the oar shaft at a desired length.

10. The rowing system of claim 1 wherein the parallel link has an adjustable length.

11. A rowing oar system with articulating handle comprising:

a) an oar shaft having two ends;

b) a blade attached to one of said two ends of said oar shaft;

c) an oarlock assembly adjustably attached to said oar shaft;

d) a handle operably attached to the other end of said oar shaft;

e) a first knuckle assembly, operably attached to said handle;

f) a first parallel link; pivotably attached to said first knuckle assembly and to said oarlock assembly;

g) a second knuckle assembly, operably attached to said handle and being oppositely disposed from said first knuckle assembly;

h) a second parallel link; pivotably attached to said second knuckle assembly and to said oarlock assembly, said second parallel link being oppositely disposed from said first parallel link; and i) a means for feathering said oar during a rowing stroke, in operable communication with said handle and said oar shaft.

12. The rowing system of claim 11 wherein the means for feathering said oar comprise a ball joint, operably installed between said handle and said oar shaft.

13. The rowing system of claim 11 wherein the means for feathering said oar comprise a universal joint, operably installed between said handle and said oar shaft.

14. The rowing system of claim 11 wherein the oar shaft has an adjustable length and further includes a means for adjusting the length of said oar shaft.

15. The rowing system of claim 11 wherein the handle is slidably attached to said oar shaft.

16. The rowing system of claim 11 further comprising an outrigger; and a means for attaching said outrigger to said oarlock assembly.

17. The rowing system of claim 16 wherein the means for attaching said outrigger include an outrigger extension bracket.

18. The rowing system of claim 11 wherein the blade is interchangeable.

19. The rowing system of claim 14 wherein the means for adjusting the length of said oar shaft include a locking mechanism to secure the oar shaft at a desired length.

20. The rowing system of claim 11 wherein the parallel link has an adjustable length.

* * * * *